US007985310B2

(12) United States Patent
Verity

(10) Patent No.: US 7,985,310 B2
(45) **Date of Patent: *Jul. 26, 2011**

(54) METAL AND METAL OXIDE GRANULES, FORMING PROCESS AND GRANULE CONTAINING EXPLOSIVES

(76) Inventor: Denis Gordon Verity, Benoni (ZA)

( * ) Notice: Subject to any disclaimer, the term of this patent is extended or adjusted under 35 U.S.C. 154(b) by 0 days.

This patent is subject to a terminal disclaimer.

(21) Appl. No.: 12/800,281

(22) Filed: May 12, 2010

(65) Prior Publication Data

US 2010/0218861 A1 Sep. 2, 2010

Related U.S. Application Data

(62) Division of application No. 10/129,374, filed as application No. PCT/IB01/01921 on Oct. 15, 2001, now Pat. No. 7,806,999.

(30) Foreign Application Priority Data

Oct. 26, 2000 (ZA) ..... 2000/6014

(51) Int. Cl.

| | |
|---|---|
| ***C06B 45/00*** | (2006.01) |
| ***C06B 45/18*** | (2006.01) |
| ***C06B 45/30*** | (2006.01) |
| ***C06B 45/04*** | (2006.01) |
| ***C06B 33/00*** | (2006.01) |
| ***C06B 33/04*** | (2006.01) |
| ***C06B 31/00*** | (2006.01) |
| ***C06B 31/28*** | (2006.01) |
| ***D03D 23/00*** | (2006.01) |
| ***D03D 43/00*** | (2006.01) |

(52) U.S. Cl. ..... 149/37; 149/2; 149/3; 149/5; 149/17; 149/43; 149/45; 149/46; 149/109.2; 149/109.4; 149/109.6

(58) Field of Classification Search ..... 149/37, 149/2, 3, 5, 17, 43, 46, 109.2, 109.4, 109.6
See application file for complete search history.

(56) References Cited

U.S. PATENT DOCUMENTS

| | | | | |
|---|---|---|---|---|
| 2,452,091 | A | 10/1948 | Woodberry et al. | 149/43 |
| 2,719,153 | A | 9/1955 | Schulz | 260/248 |
| 2,988,438 | A | 6/1961 | Allovio | 52/24 |
| 3,118,275 | A | 1/1964 | McLain | 60/219 |
| 3,266,957 | A | 8/1966 | Stresau | 149/11 |
| 3,297,503 | A | 1/1967 | Hoffmann et al. | 149/39 |
| 3,617,403 | A | 11/1971 | Johnson | 149/19 |
| 3,745,077 | A * | 7/1973 | Jones | 149/40 |
| 3,751,308 | A * | 8/1973 | Bishop et al. | 148/515 |
| 3,802,970 | A * | 4/1974 | Bishop et al. | 149/15 |
| 3,834,955 | A | 9/1974 | Fox | 149/7 |
| 3,961,106 | A | 6/1976 | Heytmeijer et al. | 427/221 |
| 4,010,234 | A | 3/1977 | Podschus | 264/117 |
| 4,013,587 | A | 3/1977 | Fisher et al. | 252/448 |
| 4,089,715 | A | 5/1978 | Scherzinger | 149/6 |
| 4,092,187 | A | 5/1978 | Hildebrant et al. | 149/11 |
| 4,256,521 | A | 3/1981 | Scherzinger | 149/6 |
| 4,357,185 | A | 11/1982 | Ringbloom | 149/6 |
| 4,367,103 | A | 1/1983 | Enever | 149/7 |
| 4,401,490 | A | 8/1983 | Alexander et al. | 149/2 |
| 4,474,715 | A | 10/1984 | Weber et al. | 264/3.1 |
| 4,565,564 | A | 1/1986 | Backlund | 71/28 |
| 4,756,250 | A * | 7/1988 | Dias dos Santos | 102/275.1 |
| 4,758,289 | A | 7/1988 | Sudweeks | 149/8 |
| 4,770,728 | A | 9/1988 | Berg et al. | 149/11 |
| 4,780,156 | A | 10/1988 | Sheeran et al. | 149/21 |
| 4,892,037 | A | 1/1990 | Betts | 102/201 |
| 4,989,515 | A | 2/1991 | Kelly et al. | 102/202.9 |
| 5,156,672 | A | 10/1992 | Bishop | 106/1.05 |
| 5,518,268 | A | 5/1996 | Moore et al. | 280/737 |
| 5,602,360 | A | 2/1997 | Sakamoto et al. | 102/220 |
| 5,868,424 | A | 2/1999 | Hamilton et al. | 280/741 |
| 7,806,999 | B2 * | 10/2010 | Verity | 149/37 |

FOREIGN PATENT DOCUMENTS

| | | | |
|---|---|---|---|
| DE | 941473 | 12/1956 | 782/2 |
| DE | 19548544 | 6/1997 | |
| GB | 276962 | 4/1928 | |
| GB | 435588 | 9/1935 | |
| GB | 1043534 | 9/1966 | |
| ZA | 96/3387 | 4/1997 | |

* cited by examiner

*Primary Examiner* — James E McDonough

(74) *Attorney, Agent, or Firm* — Michael F. Petock, Esq.; Petock & Petock, LLC

(57) ABSTRACT

This invention relates to granules comprising a homogenous mixture of metal flakes and/or metal powder and metal oxide powder, and a binder. The invention also relates to a process for producing such granules. The process includes the step of forming a mixture of metal flakes and/or metal powder and metal oxide powder, forming the mixture into a homogenous blend, adding the blend, together with a binder, to a granulator to form granules, and drying the granules. Granules so formed containing aluminum, aluminum oxide and iron oxide find particular use as sensitizers and energizers in explosives compositions.

16 Claims, 1 Drawing Sheet

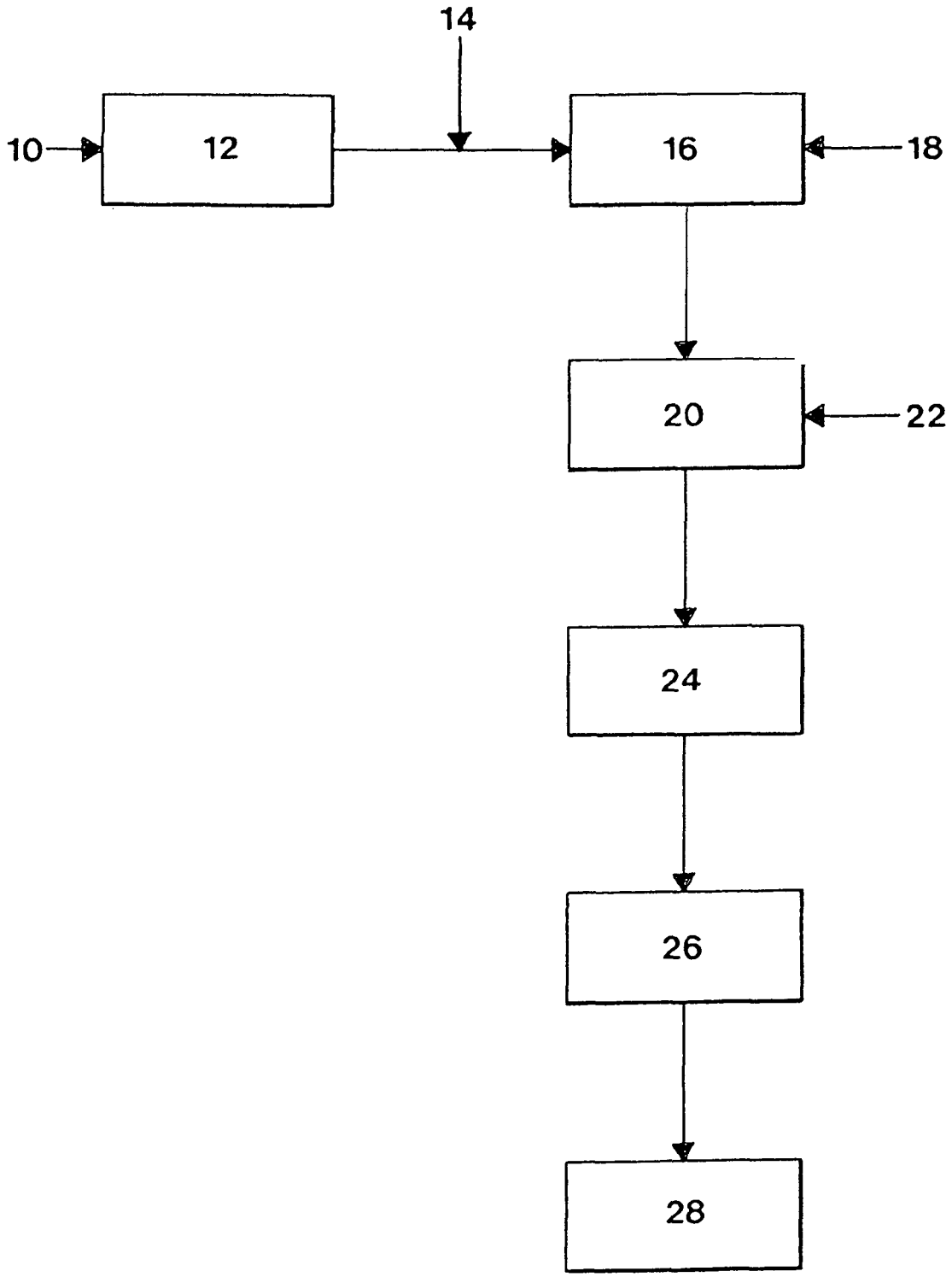
14
10
12
16
18
20
22
24
26
28

METAL AND METAL OXIDE GRANULES, FORMING PROCESS AND GRANULE CONTAINING EXPLOSIVES

CROSS REFERENCE TO RELATED APPLICATIONS

This application is a divisional application of application Ser. No. 10/129,374 filed May 6, 2002 now U.S. Pat. No. 7,806,999 by the inventor herein and entitled Metal and Metal Oxide Granules and Forming Process which is a 35 U.S.C. §371 of PCT IB01/01921 filed Oct. 15, 2001 and claims the benefit of a foreign priority date of Oct. 26, 2000 based on South African Provisional Patent Application No. 2,000/6014.

BACKGROUND OF THE INVENTION

THIS invention relates to a process for producing granules containing a homogenous mixture of metal flakes and/or metal powder and metal oxide powder, and to granules containing a homogenous mixture of metal flakes and/or powder and metal oxide powder.

Metal and metal oxide flakes and powders and mixtures of metal powders such as those described in South African patent no. 96/3387 are used as sensitisers and energisers in explosives compositions. A problem with this type of metal powder is that when it is transported, the powder is compacted in the bottom of the container in which it is carried, making it difficult to unload the powder from the container.

This is particularly troublesome when metal powders are mixed via an auger into an explosives composition from a feedbin, in situ, from a mixing truck. Compacted powder in the bottom of the feedbin causes caking and hanging up, the metal oxides separate and an incorrect amount of powder, or composition of metal powder, is added to the composition. This leads to an inconsistent mixture throughout the volume of the explosives composition, which means that the explosives composition is less effective.

U.S. Pat. No. 4,256,521 discloses a method of forming granules from aluminium powder having a high proportion of fines of a size less than 80 microns, using a synthetic resin as a binder. However, this patent does not disclose a method of forming a metal and metal oxide composition into a granule.

It is an object of this invention to provide a granule made from a metal and metal oxide composition, that is useful (in particular) as a sensitiser and/or energiser in explosives compositions.

SUMMARY OF THE INVENTION

A first aspect of the invention relates to granules comprising a homogenous mixture of metal flakes and/or powder metal and metal oxide powder, and a binder.

The metal flakes are typically less than 0.35 mm, usually from 0.05 to 0.35 mm, in size and the metal and metal oxide powder consists of particles that are less than 10 microns in size.

Typically, the granules include more than 10%, by weight, metal oxide.

The granules may include up to 90%, by weight, metal oxide.

The metal flakes and/or metal powder and metal oxide powder may comprise Al or Al alloy such as Al/Mg, and $Al_2O_3$ and other metal oxides such as $Fe_2O_3$, $MnO_3$ or $MgO_2$, preferably $Fe_2O_3$.

Advantageously, the $Fe_2O_3$ and Al are present in a ratio of at most 3:1, by mass.

The metal flakes and/or metal powder and metal oxide powder are preferably obtained from waste, typically aluminium dross and iron oxide fines.

Advantageously, the granules are in the form of porous prills.

Porous prills for use in explosives compositions typically have a free flowing apparent density of from 0.40 to 1.8 $gm/cm^3$, preferably about 1.0 to 1.5 $gm/cm^3$, most preferably about 0.9 $gm/cm^3$ and advantageously have a porosity of from 40% to 60%. The granules may vary in size from 300 to 6000 microns, typically from 30 to 900 microns.

The binder may be selected from polymers, polyalkylene carbonates, resins etc. A typically binder is a starch-based aqueous binder composition. Usually, the binder will not exceed 10%, by weight, of the composition. Another preferred binder is sodium silicate.

The granules may also include fluxing compositions such as metal salts, resins such as guar gum, Shellac or ladotol and other stearins to render the granule water resistant and resistant to decay, and sensitisers such as expanded polystyrene, micro-balloons, and glass to modify the density of the granules.

According to the second aspect of the invention there is provided an explosives composition comprising from 2% to 50%, by weight, of the metal and metal oxide porous prills described above, from 2% to 7% by weight of a fuel, typically an organic fuel, and from 50% to 95%, by weight, ammonium nitrate.

In the case of a dry ANFO explosive, the explosive composition typically includes 50% to 94% by weight of the composition ammonium nitrate porous prills, 5% to 6% by weight of the composition fuel oil and 5% to 30% by weight of the composition metal and metal oxide porous prills described above.

In the case of heavy ANFO blends and doped emulsion blends, the composition typically comprises 30% to 90% emulsified ammonium nitrate, 20% to 50% ammonium nitrate prills and 3% to 13% metal and metal oxide porous prills as described above.

A third aspect of the invention relates to a process for producing granules containing a homogenous mixture of metal flakes and/or metal powder and metal oxide powder, the process including the steps of:

1 forming a homogenous blend of finely ground metal flakes and/or metal powder and metal oxide powder in a blender;
2. adding the blend, together with a binder, a granulator to form granules containing a homogenous blend of finely ground metal flakes and/or metal powder and metal oxide powder; and
3. drying the granules.

Advantageously, an adherent, typically an organic fuel such as diesel or oleic acid, is added to the homogenous blend, to form an adhered homogenous blend which is added to the granulator.

The metal flakes, metal powder and metal oxide powders may include Al and $Al_2O_3$ and other metal oxides such as $Fe_2O_3$, $MnO_3$ or $MgO_2$, preferably $Fe_2O_3$.

The metal flakes, metal powder and metal oxide powder are preferably obtained from waste, typically aluminium dross and iron oxide fines.

The aluminium dross is processed to form aluminium flakes and powder and metal oxide powder. The aluminium content of the mixture is determined and sufficient iron oxide is added to the mixture to form a ratio of $Fe_2O_3$ to Al of at most 3:1.

Admixtures such as micro-balloons, coal dust and magnesium may be added to the mixture in step 1 to modify the sensitivity, reactivity and ignition temperature of an explosive composition into which the granules are added.

Advantageously, the dried granules are separated and classified according to size after step 3.

The dried granules may be coated with a water-resistant compound.

BRIEF DESCRIPTION OF THE DRAWING

The invention will now be described in more detail, by way of example only, with reference to the accompanying drawing which shows a schematic diagram of a process according to the invention.

DETAILED DESCRIPTION OF EMBODIMENTS

Metal and metal oxide powders and flakes to be processed in accordance with the invention include metal flakes and metal powders for use in the explosives industry, and also for use in pyrometallurgy (hot-topping and de-oxidants), pyrotechnics, solid fuels, and in the manufacture of metal salts.

The granules of the invention are made from a homogenous mixture of metal flakes and/or metal powder and metal oxide powder. The granules include a binder which holds the powder and flakes together, with the powder in close proximity to the flakes. The granules may also include other constituents such as sensitizers, and may be coated with water resistant compounds.

The metal flakes and/or metal powder comprise finely ground aluminium or an alloy of aluminium such as Al/Mg. The metal oxide is selected from $Al_2O_3$, $Fe_2O_3$, $MnO_3$ or $MgO_2$, or a mixture thereof. Typical mixtures of metal and metal oxide powders and/or flakes are described in South African patent no. 96/3387, the disclosure of which is incorporated herein by reference.

It is of the utmost importance that the metal flakes are in a homogenous mixture with the metal and metal oxide powder. The homogenous mixture ensures intimate contact between the metal and the metal oxide, which acts as fuel when the granules are used, for example as a sensitiser in explosives compositions. If there were no homogenous mixture, the metal oxide would form unreactive pockets within the granule, which negatively affects the combustion of the granule.

The Al flakes and $Al_2O_3$ powder is obtained from residues in the form of dross, skimmings, shavings and grindings from aluminium and aluminium production from primary and secondary operations which are often destined for landfill. The $Fe_2O_3$ powder is obtained from iron oxide fines obtained, for example, from processes carried out on the tailings from the mining of ore bodies or other production processes. The other metal oxides ($MnO_3$ and $MgO_2$) may also be obtained from waste.

Referring to the drawing, in accordance with the invention, aluminium dross 10 is milled in an air swept ball mill 12 to produce Al flakes having a maximum width of 0.05 mm to 0.35 mm and a fine powder with particles of the size of 10 microns and less. The powder is made up from Al, $Al_2O_3$ and small amounts of inert compounds such as silica and metal salts. Air extraction in the air swept ball mill removes some of the very finely ground $Al_2O_3$ powder and the inert compounds. The amount of Al and $Al_2O_3$ in the powder and flakes so-formed varies from one source of aluminium dross to another. A mixture of powder and flakes so-formed may comprise as little as 10% by weight Al and up to 98% by weight Al, the rest being made up mainly by $Al_2O_3$. Where the mixture of powder and flakes so-formed has a very low Al content, for example less than 25% by weight thereof, it is necessary to increase the Al content by adding higher grade Al flakes thereto. The higher grade Al flakes may be obtained from shavings, or grindings from aluminium production. The metal and metal oxide powder and flakes so-formed having an Al content of greater than 25%, by weight, and may be used as is, or mixed with another metal oxide powder 14, typically $Fe_2O_3$ powder obtained from iron oxide fines, to provide a composition of metal and metal oxide powder and flakes which may be used in explosives compositions. Ideally, $Fe_2O_3$ is added to ensure a stoichiometric ratio of $Fe_2O_3$ to Al of 3:1. A lower ratio of $Fe_2O_3$ to Al may be suitable in applications where additional gas energy is required in an explosives composition.

Table 1 below shows the amount of Al and $Al_2O_3$ in milled Al obtained from Al dross, and Table 2 below shows compositions of metal flakes and metal oxide powder which are to be formed into the granules of the invention. Composition 1 comprises Al and $Al_2O_3$. Compositions 2 to 5 comprise Al, $Al_2O_3$ and $Fe_2O_3$.

TABLE 1

| Milled Dross | 1 | 2 | 3 | 4 | 5 |
|---|---|---|---|---|---|
| % Al in milled Al by weight | 80 | 50 | 75 | 50 | 30 |
| % $Al_2O_3$ in milled Al by weight | 15 | 40 | 20 | 40 | 65 |
| % Inerts by weight | 5 | 10 | 5 | 10 | 5 |

TABLE 2

| Composition | 1 | 2 | 3 | 4 |
|---|---|---|---|---|
| % milled Al by weight | 100 | 40 | 65 | 40 |
| % $Fe_2O_3$ powder by weight (97% purity) | 0 | 60 | 35 | 60 |
| % $Al_2O_3$ in composition by weight | 15 | 16 | 13 | 26 |
| % Al metal in composition by weight | 80 | 20 | 49 | 12 |
| % metal oxide in composition by weight | 15 | 76 | 48 | 86 |
| % inert compounds by weight | 5 | 4 | 3 | 2 |

The metal and metal oxide powder and flakes composition will generally be made up by 10% to 90%, by weight, Al and 10% to 90%, by weight, metal oxide.

The abovementioned compositions of metal flakes and powder and metal oxide powder are prepared in bulk quantities (i.e. 1 to 10 tons at a time). To produce compositions 2 to 5 (ie the compositions that contain Al, $Al_2O_3$ and another metal oxide ($Fe_2O_3$)), bulk quantities of the milled Al and $Al_2O_3$ flakes and powder are mixed with bulk quantities of the $Fe_2O_3$ powder. In these circumstances, the amount of Al in the milled Al and $Al_2O_3$ flakes and powder derived from aluminium dross is measured and the amount of $Fe_2O_3$ powder added is altered according to the percent Al in the milled Al and $Al_2O_3$ flakes and powder. Table 3 below shows the percentage of milled Al and $Al_2O_3$ powder and flakes added to the total tonnage of the final composition of milled Al and $Al_2O_3$ and $Fe_2O_3$, depending on the percentage Al therein.

TABLE 3

| | 1 | 2 | 3 | 4 | 5 |
|---|---|---|---|---|---|
| % Al purity in milled Al and $Al_2O_3$ flakes and powder | 60 | 50 | 40 | 30 | 25 |
| % Al and $Al_2O_3$ flakes and powder in Al and $Al_2O_3$ and $Fe_2O_3$ composition | 36 | 40 | 45 | 52 | 57 |
| % Al in Al and $Al_2O_3$ and $Fe_2O_3$ composition | 21 | 20 | 18 | 15 | 14 |

The abovementioned compositions are then formed into granules, typically porous prills, in a granulator using a suitable binder. It is most important that the granules contain a homogenous mixture of flakes and powder, so that the metal is in intimate contact with the powder to ensure that the metal reacts with the metal oxide, in use. If there is no homogeneity, clusters of powder would result, and this negatively effects the reaction of the metal with the metal oxide.

Before granulation, the composition of metal flakes and powder and metal oxide powder are then blended in a blender 16 (for example a ribbon blender or paddle mixer typically running at 30-100 rpm), to form a homogenous mixture of metal flakes and powder and metal oxide powder. An adherent 18 (typically an organic fuel such as diesel or oleic acid), is added to the blender to adhere the metal flakes and powder and metal oxide powder together in an homogeneously blended mixture. Fluxing agents such as metal salts may be added to the blend for pyrometallurgical applications. Other sensitisers such as expanded polystyrene, micro-balloons, glass etc. may be added to the blend to increase the sensitivity of an explosives composition in which the granules are used, and also to alter the density of the granules.

From the blender 16, the homogenous blend is sent to a granulator 20. The granulator 20 includes a stainless steel drum which is liquid cooled, to ensure that the composition remains cool during the granulation process (heat caused by friction in the granulator could result in an exothermic reaction). Housed in the drum is a series of mixer blades located on a central driven shaft. The mixer blade design and angle, and the linear speed of the blades are selected to determine the size and porosity of the granules (which are porous prills).

An operator begins the granulating process by continuously feeding the adhered blended mixture into the granulator 20, while spraying a binder 22 into the granulator 20 at the same time. The operator will control the size of the granules and porosity thereof by adjusting the rate at which the homogenous blend and binder is fed into the granulator, and the speed of the blades. For small granules of a high porosity, the granulator is run at a high speed of 800-1000 rpm. The operator monitors the build-up of granules in the granulator and the pneumatic valve on the side of the granulator is opened periodically to discharge green granules from the granulator.

The design of the granulator 20 also permits the inclusion in the production process of admixtures such as density modifiers once the binders have been introduced into the compositions being prilled.

Many binders may be used. Binder properties which are essential in production are as follows:

1. The binder must mix uniformly with the composition.
2. Provide sufficient green strength to allow for further processing.
3. The binder must not decompose during the processing of the green body.
4. The binder in most application must burn out completely (in all atmospheres preferably leaving minimal ash residue).

Binders such as Dextrin, starch, polyalkylene carbonates, resins and many others, can be used in the agglomeration and production of porous prilled granules. The choice of binder used is determined by the end use of the prill. Aqueous dextrin has been found to be useful in the production of prills according to the invention for use in explosives compositions, where very finely divided metals and metal/metal oxide powders are prilled.

Sodium silicate may be used as a binder in explosives and pyrometallurgical applications and high alumina cements in order to maintain prill integrity in rough handling conditions and amongst other characteristics, slow down or accelerate the ignition of the compositions being introduced. Certain binders have the chemical attributes required to modify reaction/ignition temperature without admixtures such as many metal salts. They are also water and solvent resistant and do not require that the prilled products need to be additionally coated following production.

Following the granulating/prilling process in the granulator 18, the green granules are conveyed to a vibrating screen 24 (if desired), which assists in breaking any agglomerated green product, then to a rotary drier 26, and lastly to a final infra-red drying stage 28.

The granules may be produced with, or coated with, water-resistant agents such as resins for example Shellac or ladotol to render the granule water-resistant for particular applications. However, in some applications, for example for use in emulsion explosives, the granules are not made water resistant, so that the granules break down when added to the emulsion mixture.

Granules so produced may vary in size from 30 microns to 30 mm in diameter.

Preferred granules of the invention are porous prills.

The size of granules for explosives compositions could be from 300 microns to 6 mm, with a free flowing apparent density (ASTMSTD) of from 0.4 to 3.0 gm/cm$^3$. The usual density for a bulk explosives mix is about 0.92 gm/cm$^3$ and the porosity of the granules may be from 40% to 60%.

In a preferred embodiment, the metal and metal oxide granules are used as a sensitizer or energiser in dry ANFO mixes and heavy ANFO mixes, doped emulsion blends and packaged explosives preparations. Typically, the granules are added in an amount of from 2% to 30% by weight (usually not more than 10% by weight) of the explosives composition which further comprises from 2% to 5% by weight of fuel, typically an organic fuel such as diesel, and from 30% to 90% by weight of the composition ammonium nitrate. Explosive compositions normally contain about 85% to 96% ammonium nitrate and the presence of the granules of the invention can allow for a reduction of ammonium nitrate of up to 50%, of the composition.

Table 4 below provides examples of typical dry ANFO mixes and Table 5 below provides examples of typical heavy ANFO blends utilising the homogenous granules of metal flakes and powder and metal of the invention.

TABLE 4

| | 1 | 2 | 3 | 4 | 5 | 6 |
|---|---|---|---|---|---|---|
| Ammonium Nitrate (porous prills) % by mass of the composition | 65 | 70 | 75 | 80 | 85 | 90 |
| Fuel Oil % by mass of the composition | 5.5 | 5.5 | 5.5 | 5 | 5 | 3 |
| Metal Powder Granules % by mass of the composition | 29.5 | 24.5 | 19.5 | 15 | 9.5 | 7 |
| Al Metal % by mass of the metal powder granule | 20 | 20 | 20 | 20 | 20 | 20 |
| $Al_2O_3$ % by mass of the metal powder granule | 16 | 16 | 16 | 16 | 16 | 16 |
| $Fe_2O_3$ % by mass of the metal powder granule | 60 | 60 | 60 | 60 | 60 | 60 |
| Free Flowing Apparent Density of Metal Powder Granules gm/cm$^3$ | 1.4 | 1.4 | 1.4 | 1.4 | 1.4 | 1.4 |
| Size of granule microns | 300-890 | 300-890 | 300-890 | 300-890 | 300-890 | 300-890 |

TABLE 5

| | 1 | 2 | 3 | 4 | 5 | 6 | 7 | 8 |
|---|---|---|---|---|---|---|---|---|
| Emulsified Ammonium Nitrate % by mass of the composition | 55 | 60 | 60 | 60 | 60 | 65 | 65 | 65 |
| Ammonium Nitrate Porous Prill % by mass of the composition | 40 | 34 | 33 | 32 | 31 | 25 | 24 | 24 |
| Metal Powder Granules % by mass of the composition | 5 | 6 | 7 | 8 | 9 | 10 | 11 | 10 |
| Al Metal % by mass of the metal powder granule | 20 | 20 | 20 | 20 | 20 | 20 | 20 | 80 |
| Al2O3 % by mass of the metal powder granule | 16 | 16 | 16 | 16 | 16 | 16 | 16 | 20 |
| Fe2O3 % by mass of the metal powder granule | 60 | 60 | 60 | 60 | 60 | 60 | 60 | 0 |
| Free Flowing Apparent Density of Metal Granules gm/cm3 | 1.4 | 1.4 | 1.4 | 1.4 | 1.4 | 1.4 | 1.4 | 1.2 |
| Size of granule microns | 300-890 | 300-890 | 300-890 | 300-890 | 300-890 | 300-890 | 300-890 | 1000-2000 |

The granulated metal powder granules made according to the invention have many advantages including:

1. The flow-handling of the granules is far better than that of powder and stops caking and hanging up of the product in feed bins and improves calibration and delivery of the product, with less wear on pumps and augers;
2. As the metal powder is bound in granules, there is much less dust;
3. There is no segregation of the aluminium, aluminium oxide and iron oxide in the granule, ie. the granule contains the metal components in the powder homogeneously;
4. The compressive strength of the granules can be varied (by varying the amount and type of binder), according to need;
5. The granules can be classified into particular sizes for particular applications;
6. It is convenient to add desired compounds or compositions to the powder, prior to granulation to alter the characteristics of the granules. Furthermore, certain admixtures can be added prior to granulation to modify the oxygen balance which affects the energy yield of the granule.
7. When used in an explosives composition, the granules reduce the density of the composition and there is better distribution of the sensitizer/energiser within the explosives composition. Also, the density of the granules can be adjusted to adjust the density of the explosives composition. Such compositions are also more stable and safer to store, handle and transport.
8. A starch-based aqueous binder composition is relatively inexpensive and the starch combusts and thus plays an active role in an explosives reaction when the granules are used in explosives compositions.
9. The granules can be coated to make them resistant to water when water dissolvable binding systems are used in explosive compositions.
10. If there are any free heavy metals in the powdered composition which may affect the base product stability, for example, PH once prilled, the binder composition, which is stable and additional coating thereafter will prevent any potential emulsion breakdown, in the case of explosives compositions.

Example 1

Aluminium dross was obtained from the production of aluminium alloys from secondary and primary metal. The aluminium dross was milled in an air swept ball mill to produce aluminium flakes having a maximum width of 0.05 mm to 0.1 mm and a fine powder which included Al, $Al_2O_3$ and small amounts of inert compounds such as silica. Air extraction in the air swept ball mill removed some of the very finely ground $Al_2O_3$ powder and inert compounds. The flakes and powder so-produced were tested and found to contain 50% Al, the rest being made up mainly by $Al_2O_3$. 400 kg of this Al and $Al_2O_3$ powder and flakes was then mixed with 600 kg of $Fe_2O_3$ powder obtained from iron oxide fines to provide a composition of metal and metal oxide powder containing 20%, by mass, Al, 20%, by mass, $Al_2O_3$, and 60%, by mass, $Fe_2O_3$.

The metal powder composition was sent to a ribbon blender which was running at a speed of 30 rpm, to form it into a homogenous mixture of metal flakes and powder and metal oxide powder. 3 kg of diesel was added to the blender to adhere the composition together, in a homogenous blend.

Example 2

The adhered homogenous composition described in Example 1 was then mixed with a starch-based aqueous binder to provide metal powder granules according to the invention.

The starch-based aqueous binder composition was formed from 40 parts by weight of a starch, namely dextrin yellow, 60 parts by weight water, 9 parts by weight of a thickener such as borax and 1 part by weight sodium hydroxide which is also a thickener. 0.4 kg of dextrin yellow, 0.09 kg of borax and 0.01 liter of sodium hydroxide solution was added to the solution to form the starch-based aqueous binding composition.

1000 kg of adhered homogenous composition described in Example 1 was fed into a high-speed granulator. The blade design of the mixer was designed to provide a maximum shearing effect in order to produce small diameter granules. The mixer was operated at a speed of 920 rpm (the high speed ensured a high porosity of the granules) and 100 kg of the starch-based binder composition described above was added to the granulation mixer from a sprayer, at 30 ml/m. Granules were formed in 5 minutes.

From the granulator, the granules were fed into a tumbling mill which reduced agglomerates and then into a rotary dryer which was operated at a temperature of 250° C. From the rotary dryer, the dried granules were fed into a multi-deck vibrating screen which classified the granules into different sizes.

From the vibrating screen, the classified granules were introduced into a flow mixer which coated the granules with a water resistant agent (oleic acid).

The granules so produced had a free flowing apparant density of 1.4, a porosity of 45%, and a diameter of from 30 to 6000 microns.

I claim:

1. Granules comprising a binder and a homogenous mixture of metal flakes and/or metal powder and metal oxide powder, wherein the granules have a porosity of from 40% to 60% and wherein the binder is selected from the group consisting of sodium silicate, Dextrin, starch, polyalkylene carbonates and resins.

2. An explosives composition comprising:

from 2% to 50%, by weight, of granules comprised of a binder and a homogenous mixture of metal flakes and/or metal powder and metal oxide powder, wherein the granules have a porosity of from 40% to 60%;

from 2% to 7% by weight of a fuel; and from 50% to 95%, by weight, ammonium nitrate.

3. A dry ANFO explosives composition comprising:

50% to 94% by weight of the composition ammonium nitrate porous prills;

5% to 6% by weight of the composition fuel oil; and

5% to 30% by weight of granules comprising a binder and a homogenous mixture of metal flakes and/or metal powder and metal oxide powder, wherein the granules have a porosity of from 40% to 60%.

4. A heavy ANFO blend or doped emulsion blend composition comprising:

30% to 90% emulsified ammonium nitrate;

20% to 50% ammonium nitrate prills; and

3% to 13% of granules comprising a binder and a homogenous mixture of metal flakes and/or metal powder and metal oxide powder, wherein the granules have a porosity of from 40% to 60%.

5. A process for producing the granules of claim 1, 2, 3 or 4; the process including the steps of:

1. forming a homogenous blend of finely ground metal flakes and/or metal powder and metal oxide powder in a blender;
2. adding the blend, together with a binder, into a granulator to form granules containing a homogenous blend of finely ground metal flakes and/or metal powder and metal oxide powder;
3. drying the granules; and
4. wherein the granules contain a homogenous mixture of metal flakes and/or metal powder and metal oxide powder, and have a porosity of from 40% to 60%.

6. A process according to claim 5 wherein an adherent is added to the homogenous blend, to form an adhered homogenous blend which is added to the granulator.

7. A process according to claim 6 wherein the adherent is an organic fuel.

8. A process according to claim 7 wherein the organic fuel is diesel or oleic acid.

9. A process according to claim 5 wherein metal flakes and metal powder are Al metal and the metal oxides are $Al_2O_3$ and another metal oxide or oxides.

10. A process according to claim 9 wherein the other metal oxides are $Fe_2O_3$, $MnO_3$ or $MgO_2$.

11. A process according to claim 9 wherein the other metal oxide is $Fe_2O_3$.

12. A process according to claim 5 wherein the metal flakes and metal powder and metal oxide powder are obtained from waste.

13. The process according to claim 6 wherein the homogenous blend of finely ground metal flakes and powder and metal oxide powder is obtained from aluminum dross which is processed to form aluminum flakes and aluminum powder and $Al_2O_3$ powder.

14. A process according to claim 13 wherein the aluminum content of the processed mixture is determined and sufficient iron oxide is added to the mixture to form a desired predetermined ratio of $Fe_2O_3$ to Al.

15. A process according to claim 5 wherein the dried granules from step 3 are separated and classified according to size.

16. A process according to claim 5 wherein the dried granules are coated with a water-resistant compound.

* * * * *